US006666669B2

(12) United States Patent
Süss

(10) Patent No.: US 6,666,669 B2
(45) Date of Patent: Dec. 23, 2003

(54) SCROLL COMPRESSOR HAVING AN ANTI-ROTATIONAL ARRANGEMENT INCLUDING AN AXIAL BEARING

(75) Inventor: Jürgen Süss, Augustenborg (DE)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 10/198,211

(22) Filed: Jul. 17, 2002

(65) Prior Publication Data

US 2003/0017071 A1 Jan. 23, 2003

(30) Foreign Application Priority Data

Jul. 19, 2001 (DE) ..... 101 35 254

(51) Int. Cl.[7] ..... F04C 18/04; F16D 3/04
(52) U.S. Cl. ..... 418/55.3; 464/102
(58) Field of Search ..... 418/55.3; 464/102

(56) References Cited

U.S. PATENT DOCUMENTS 4,259,043 A 3/1981 Hidden et al. ..... 418/55.3
4,886,433 A * 12/1989 Maier ..... 418/55.3
5,147,192 A * 9/1992 Suzuki et al. ..... 418/55.3
5,180,295 A 1/1993 Swain et al. ..... 418/55.3
5,320,506 A * 6/1994 Fogt ..... 418/55.3
5,462,418 A * 10/1995 Shimizu et al. ..... 418/55.3
5,478,223 A * 12/1995 Yamamoto et al. ..... 418/55.3
5,919,034 A * 7/1999 Kawano et al. ..... 418/55.3

FOREIGN PATENT DOCUMENTS

DE 35 19 244 C2 11/1991 ..... F04C/18/04
DE 44 96 503 C2 11/1998 ..... F04C/18/04
JP 2-161189 * 6/1990 ..... 418/55.3
JP 5-195965 * 8/1993 ..... 418/55.3

* cited by examiner

*Primary Examiner*—John J. Vrablik
(74) *Attorney, Agent, or Firm*—McCormick, Paulding & Huber LLP

(57) ABSTRACT

The invention concerns a scroll compressor with at least one fixed displacement element, at least one movable displacement element, which is guided in relation to the fixed displacement element with an orbiting movement, and a gear arrangement, which ensures a non-rotational movement of the movable displacement element and comprises an axial bearing, via which the movable displacement element is supported in an axial direction.

15 Claims, 4 Drawing Sheets

SCROLL COMPRESSOR HAVING AN ANTI-ROTATIONAL ARRANGEMENT INCLUDING AN AXIAL BEARING

CROSS-REFERENCE TO RELATED APPLICATIONS

This application is entitled to the benefit of and incorporates by reference essential subject matter disclosed in German Patent Application No. 101 35 254.9 filed on Jul. 19, 2001 in the name of Danfoss A/S.

1. Field of the Invention

The invention concerns a scroll compressor with at least one fixed displacement element, at least one movable displacement element, which is guided in relation to the fixed displacement element with an orbiting movement, and a gear arrangement, which ensures a non-rotational movement of the movable displacement element, and comprises an axial bearing, via which the movable displacement element is supported in an axial direction.

2. Background of the Invention

A scroll compressor of this kind is known from U.S. Pat. No. 5,180,295. It has a displacement element, which is fixedly connected with a housing of the compressor. An Oldham-coupling moves the movable displacement element in an orbiting manner around an axis in relation to this fixed displacement element. At the same time, the movable displacement element is supported on the housing in the axial direction via the Oldham-coupling and thus held in its position on the fixed displacement element. To permit the orbiting movement and at the same time prevent a rotation of the movable displacement element, the Oldham-coupling has pins projecting both in a direction towards the displacement element and in a direction towards the housing. These pins cooperate with groove-shaped pin paths, which are formed on both the movable displacement element and on the housing. The Oldham-coupling moves along the pin paths in a combination of two linear movements perpendicular to each other. To reduce the friction between the Oldham-coupling and the displacement element or the housing, respectively, both the displacement element and the housing have two roller-bearings, which cooperate with the Oldham-coupling in the axial direction.

With the embodiment described, having two bearing areas on one side of the Oldham-coupling, tilting movements of the movable displacement element may appear. On the other hand, the embodiments with four bearing areas on one side of the Oldham-coupling are very expensive, not least because in this embodiment each bearing area comprises roller bearings.

U.S. Pat. No. 4,259,043 shows a scroll compressor with two mutually orbiting displacement elements, in which the gear arrangement is formed between the movable displacement element and the housing by means of a ball-bearing ring with a plurality of rotatable balls. The balls of this gear arrangement cooperate on both sides of the ball-bearing ring with recesses in the housing or the movable displacement element, respectively. The movement play of the balls in the respective recesses is so large that the movable displacement element is guided in an orbiting manner in relation to the housing and the fixed displacement element. At the same time, the balls, together with the recesses, prevent a rotation of the movable displacement element in relation to the housing. Further, the balls ensure support on the housing in the axial direction of the orbiting movement.

Also with this scroll compressor, the intermediate coupling can be used to prevent a rotary movement of the movable displacement element and to support the movable displacement element in the axial direction. However, the recesses required for each individual ball are very costly to produce.

SUMMARY OF THE INVENTION

The present invention is based on the task of improving the support of the orbiting displacement element with a simple design of the scroll compressor.

This task is solved in that the axial bearing comprises three first bearing areas, which cooperate with the movable displacement element.

This is achieved during operation wherein the movable displacement element is supported on the intermediary coupling on three predetermined areas, and thus in a statically determined way. First, a tilting movement of the displacement element in relation to the intermediary coupling is avoided. Second, the axial forces to be transmitted are distributed in a relatively uniform way on all bearing areas, the term "axial" referring to the axis, around which the orbiting movement of the movable displacement element occurs. Further, the position of the displacement element in relation to the intermediary coupling is ensured by only three, bearing areas. Thus, it is possible, in spite of a simple design of the scroll compressor to ensure a stable support of the orbiting displacement element.

It is advantageous that the axial bearing comprises exactly three second bearing areas, which cooperate with a supporting part. Thus, next to the stable support of the movable displacement element on the gear arrangement, also a stable support of the gear arrangement on the supporting part is ensured. The supporting part may be a fixedly mounted element, which is arranged, for example, on the housing or on the fixed displacement element. However, it is also possible for the supporting part to be formed by the housing or the fixed displacement element.

It is favourable that the gear arrangement comprises a supporting element, on which at least one of the first bearing areas is arranged opposite to one of the second bearing areas in the axial direction. Thus, the two bearing areas are arranged directly behind each other in the axial direction. An axial pressure force occurring on the movable displacement element can thus be transferred directly to the second bearing area and the supporting part via the first bearing area and the supporting element, without the presence of an internal lever arm between the two bearing areas. This means a substantial reduction of the stress on the supporting element. Thus, it is possible to make the supporting element with a relatively lower axial thickness. In this way, also the axial length of the scroll compressor can be reduced.

Further, it is favourable that each bearing area has a sliding surface. Thus, the bearing surfaces act as linear slide bearings. This means that the axial force transmission from the movable displacement element to the supporting element and/or from the supporting element to the supporting part can also take place during a movement of the supporting element in relation to the movable displacement element and/or the supporting part. This still permits the bearing areas to be manufactured in a simple way.

Further, it is advantageous that the sliding surface has a hydrodynamic profile. This enables improved formation of a lubricant layer between the bearing area and the movable displacement element or the supporting part, respectively. In this way, the frictional losses during operation can be substantially reduced.

It is also favourable that the sliding surfaces are curved in a movement direction, in which the sliding surfaces move in relation to the movable displacement element or the supporting part against which they abut. Thus, it is possible that, next to the effect of functioning as an axial bearing, the supporting element with the bearing areas also permit a good conversion of the orbiting movement of the movable displacement element into two linear movements, which are approximately perpendicular to each other. In this way, it is also possible to achieve improved lubrication in the bearing areas thereby reducing friction and wear in the axial bearing.

An advantage of the present invention is that at least partially, the bearing areas have a surface where lubrication is enhanced. To produce a surface with enhanced lubrication properties, any suitable and known microstructure can be used. By means of such a surface, the friction between the bearing areas and the movable displacement element or the supporting part, respectively, can be further reduced. Thus, the operating conditions of the scroll compressor can be improved.

Preferably, at least one of the bearing areas is formed on a free end of a bearing pin, which cooperates with the movable displacement element or the supporting part approximately perpendicularly to the axial direction. Thus, it is possible in a simple manner to achieve good cooperation between the supporting element and the movable displacement element or the supporting part also approximately perpendicular to the axial direction. This means that, next to the conversion of the orbiting movement into a linear movement, axial forces can be transmitted via the bearing area through the bearing pin. Thus, such a bearing pin fulfils two functions at the same time, which means that manufacture of the scroll compressor can be further simplified.

It is also advantageous that at least one of the bearing pins cooperates with the movable displacement element and at least one other bearing pin cooperates with the supporting part approximately perpendicularly to the axial direction. In this way, cooperation of the movable displacement element with the supporting part via the supporting element approximately perpendicularly to the axial direction can also be realised with a simple embodiment of the scroll compressor.

It is also favourable that two bearing pins project from both an upper side and a bottom side of the supporting element. By means of these two bearing pins it can be achieved that both the movable displacement element and the supporting part can be guided in a stable linear path in relation to the supporting element. Thus, good supporting conditions of the movable displacement element are also ensured approximately perpendicularly to the axial direction.

It is advantageous that three of the bearing pins each comprise a bearing area, each of these pins being arranged on the supporting element in the axial direction opposite to one of the other bearing areas. Thus, with a simple design of the gear arrangement a high stability can be achieved.

It is also advantageous that the bearing pins are substantially the same size. Thus, with a uniform distribution of the bearing pins on the supporting element a good balance can be achieved, which reduces wear.

In an alternative embodiment, the bearing pins can have different sizes. Thus, the size of each bearing pin can be adapted the load that will be exerted on it during operation. This makes it possible to reduce the weight of the gear arrangement.

Further, it is advantageous that the supporting element has an annular shape. Such a design gives an improved flux of force in the supporting element, as the forces acting upon the bearing pins through the orbiting movement of the displacement element will act approximately tangentially upon the ring.

It is advantageous that the three first bearing areas and/or the three second bearing areas are arranged on the annular supporting element at mutual distances of approximately 120°. In this way it is possible, to maintain a high stability in the support of the movable displacement element.

Further, it is favourable that the supporting element comprises approximately straight connecting elements. In spite of a reduced material consumption, which causes a reduction of the mass of the supporting element and of the occurring inertia forces, a high stability of the supporting element can be achieved.

BRIEF DESCRIPTION OF THE DRAWINGS

In the following, the invention is described in detail on the basis of preferred embodiments in connection with the drawings, wherein.

DETAILED DESCRIPTION OF THE PREFERRED EMBODIMENTS

Figure 1:
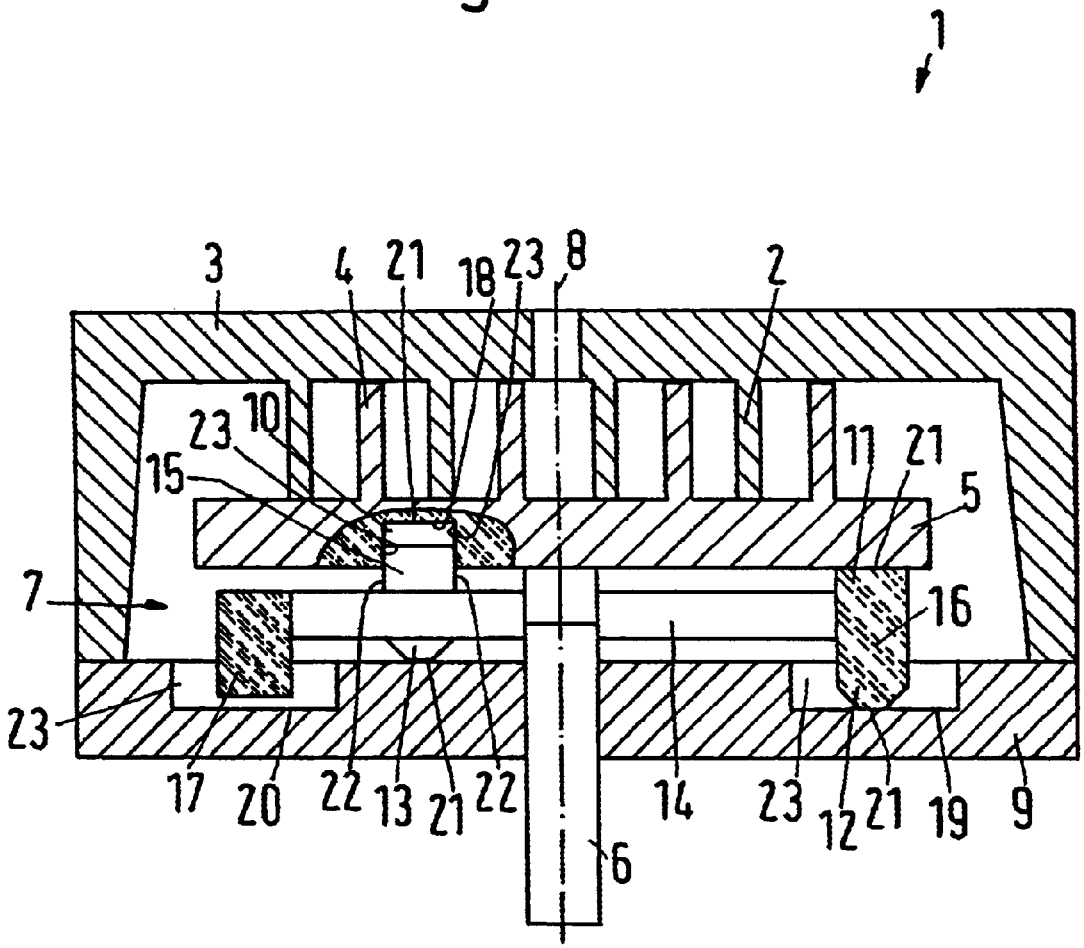
FIG. 1 is a cross-section through a scroll compressor with a gear arrangement.

FIG. 1 shows a scroll compressor 1 with a fixed displacement element 2, which is arranged on a housing 3. Further, the scroll compressor 1 has a movable displacement element 4 with a base plate 5, the movable displacement element 4 being movable in relation to the fixed displacement element 2 via a crank shaft 6. The movable displacement element 4 is supported on a supporting part 9 in the direction of an axis 8 via the base plate 5 and a gear arrangement 7. The support occurs via first bearing areas 10, 11 and second bearing areas 12, 13 of the gear arrangement 7, the first bearing areas 10, 11 cooperating with the base plate 5 of the movable displacement element 4 and the second bearing areas 12, 13 cooperating with the supporting part 9.

The gear arrangement 7 comprises a supporting element 14, on which bearing pins 15, 16, 17 are formed, which project from the supporting element 14 in the direction of the axis 8. The bearing pin 15 extends into a pin path 18, defined by the base plate 5 of the movable displacement element 4. The pin path 18 is in the shape of a groove. The bearing pins 16, 17 extend into pin paths 19, 20 respectively, defined by the supporting part 9. Each bearing area 10, 11, 12, 13 has a sliding surface 21, via which the gear arrangement 7 bears on the base plate 5 or on the supporting part 9, respectively, in the axial direction 8. Additionally, the bearing pins 15, 16, 17 have guiding surfaces 22, which cooperate with groove walls 23 of the pin paths 18, 19, and 20.

Figure 2:
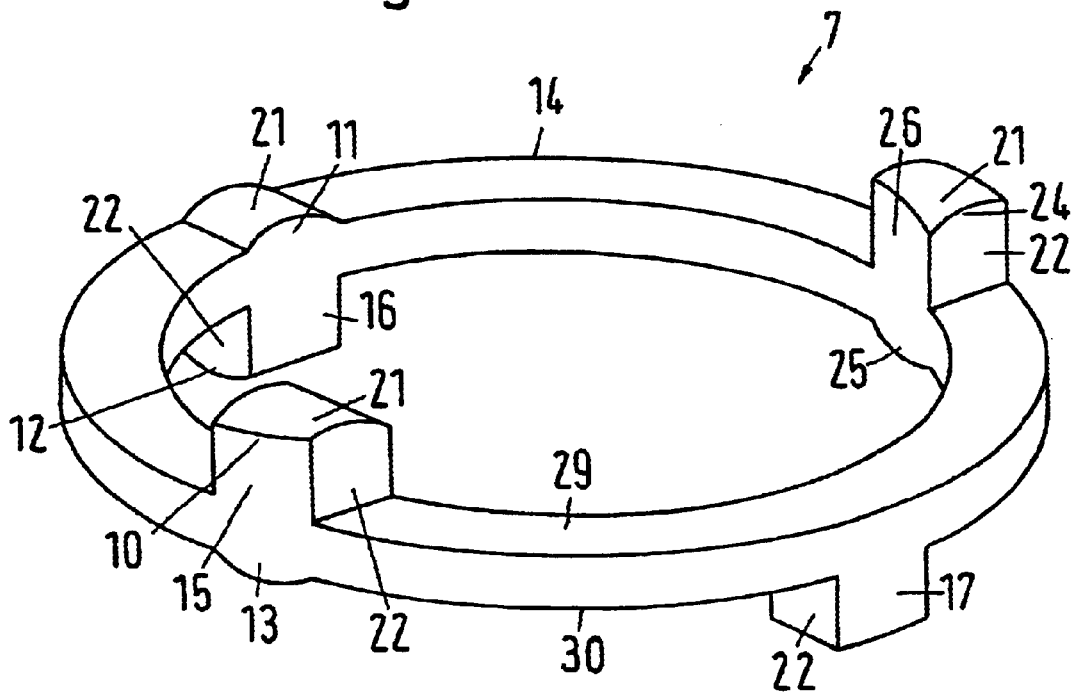
FIG. 2 is an inclined top view of the gear arrangement.
Figure 3:
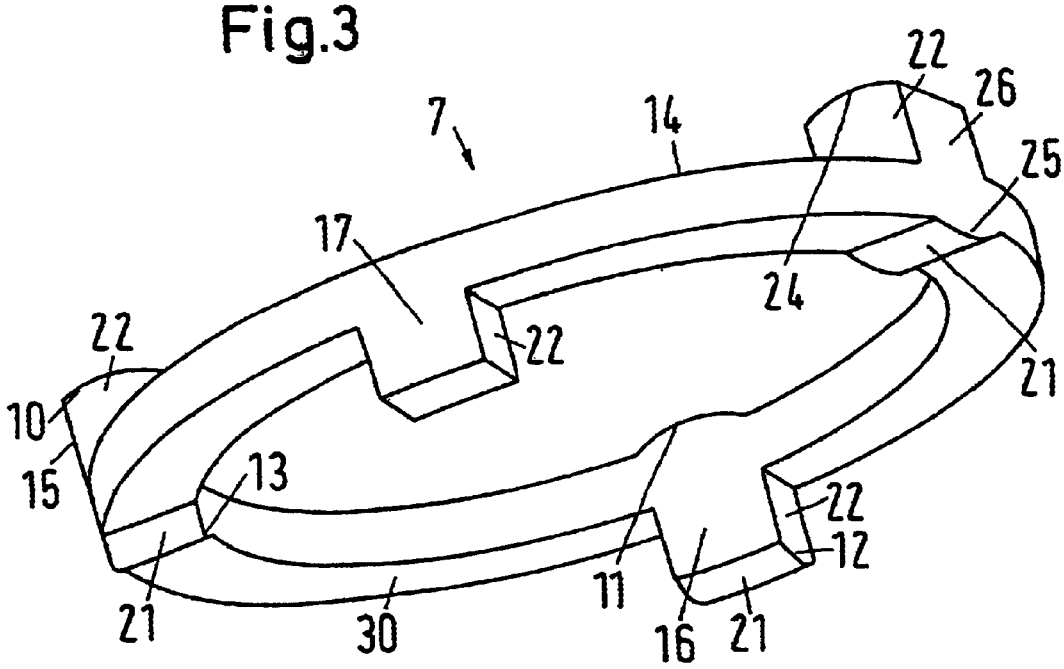
FIG. 3 is an inclined bottom view of the gear arrangement.
Figure 4:
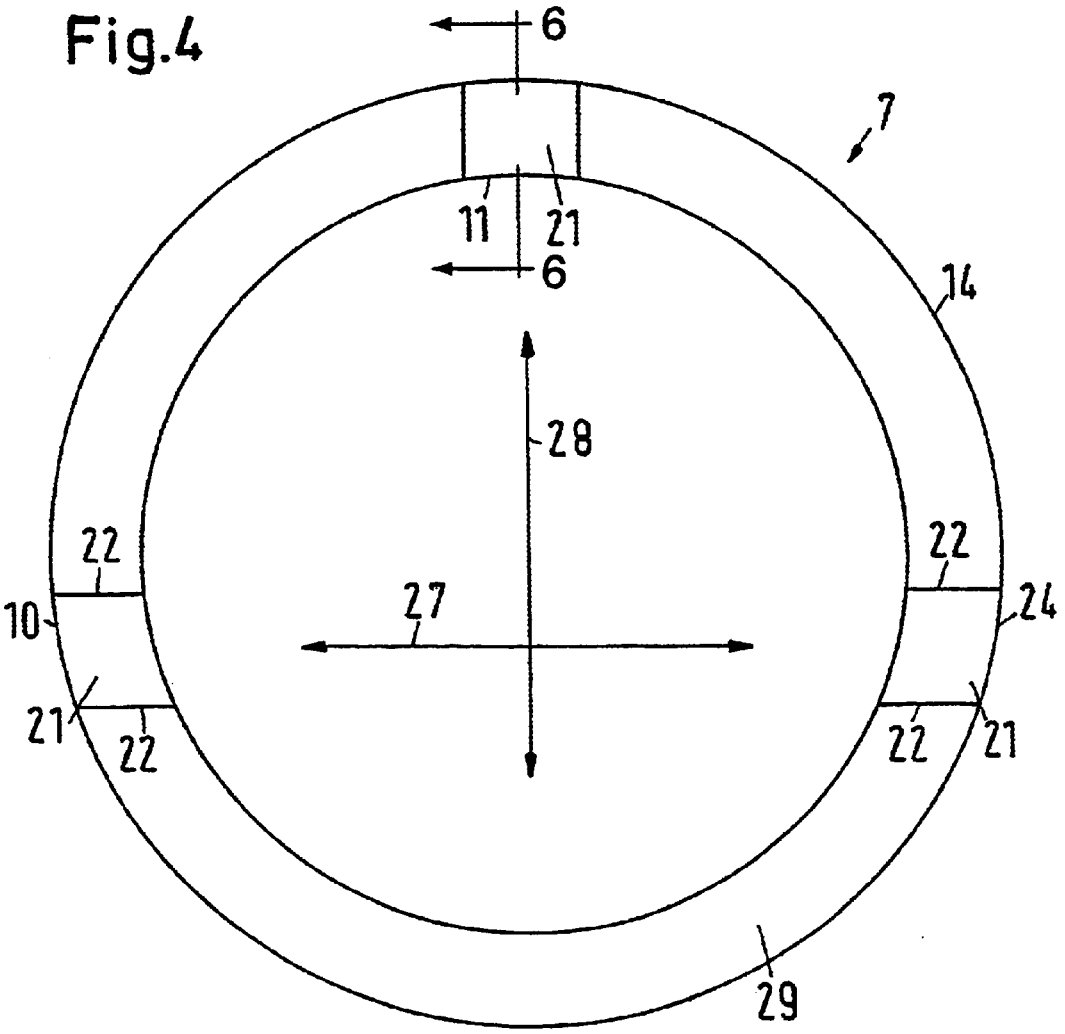
FIG. 4 a top view of the gear arrangement.
Figure 5:
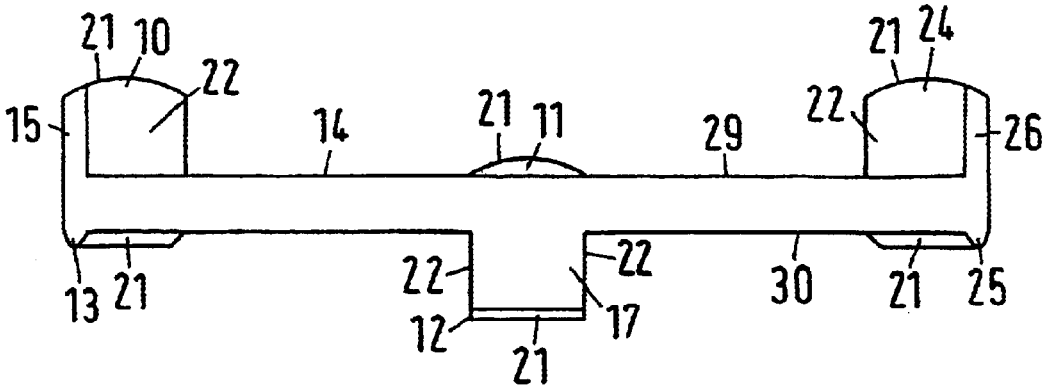
FIG. 5 a side view of the gear arrangement.

FIG. 2 is a presentation of the complete gear arrangement 7. Corresponding elements shown in FIG. 2 bear the same reference numbers as in FIG. 1. It can be seen that in addition to the first bearing areas 10, 11 and the second bearing areas 12, 13, the gear arrangement 7 has another first bearing area 24 and another second bearing area 25. Further, FIG. 2 also shows an additional bearing pin 26 next to the bearing pins 15, 16, 17. The bearing pin 26 also has guiding surfaces 22. Additionally, the first bearing area 24 and the second bearing area 25 have sliding surfaces 21.

In the gear arrangement 7 shown, each of the two first bearing areas 10, 24 and the second bearing area 12 are formed at the end of one of the bearing pins 15, 16, 26. The first bearing area 11, however, is formed on an upper side 29 of the supporting element 14. Accordingly, the second bearing areas 13, 25 are formed on a bottom side 30 of the supporting element 14. The terms "upper side" and "bottom side" merely refer to the presentation shown. Of course, also any other orientation of the supporting element 14 can be imagined.

During operation of the scroll compressor 1, the movable displacement element 4 is displaced in relation to the fixed displacement element 2 in an orbiting movement around the axis 8. The movable displacement element 4 is driven via the crank shaft 6. At the same time, a rotary movement of the movable displacement element 4 is prevented via the gear arrangement 7.

The gear arrangement 7 is made as some sort of Oldham-coupling, which substantially consists of the supporting element 14 with the bearing areas 10, 11, 12, 13, 24, 25 and the bearing pins 15, 16, 17, 26, and is arranged between the movable displacement element 4 and the supporting part 9. Via the bearing pins 15, 16, 17, 26, which are reciprocating in the corresponding, straight extending pin paths 18, 19, 20, this Oldham-coupling converts the rotary movement of the crank shaft 6 into the orbiting movement of the movable displacement element 4. The bearing pins 15, 26 arranged on top of the supporting element in FIGS. 1 to 5 are guided via the corresponding pin paths 18 in the base plate 5 of the movable displacement element 4 along the movement direction 27. This direction is perpendicular to the movement direction 28, in which the bearing pins 16, 17 on the bottom of the supporting element 14 move in the pin paths 19, 20 in the supporting part 9.

Here and in the following, the terms top and bottom merely refer to the presentation in the FIGS. 1 to 5. Of course, it is, however, also possible that the scroll compressor 1 and the gear arrangement 7 have any other possible orientation. Further, it is of course also possible to design the scroll compressor 1 in such a way that the first bearing areas 10, 11, 24 and bearing pins 15, 26 arranged on top in the drawings cooperate with the supporting part 9, whereas the second bearing areas 12, 13, 25 and bearing pins 16, 17 shown in the drawings at the bottom of the supporting element 14 cooperate with the movable displacement element 4.

Further, also embodiments of the gear arrangement 7 are contemplated by the present invention, in which all bearing pins 15, 16, 17, 26 project in the axial direction from the same side of the supporting element 14. In this connection, the bearing pins 15, 16, 17, 26 are, for example, partly guided in pin paths 18, 19, 20 of the movable displacement element 4 and partly by pin paths 18, 19, 20 in the fixed displacement element 2. In this way, a very exact guiding of the movable displacement element 4 in relation to the fixed displacement element 2 can be achieved. The second bearing areas 12, 13, 25, which cooperate with the supporting part 9, however, can only be made separately from the bearing pins 15, 16, 17, 26.

Through the orbiting movement of the displacement elements 2, 4 in relation to each other, a medium is compressed during operation in a known manner. Pressures are generated, which are supposed to move the movable displacement element 4 away from the fixed displacement element 2 in the axial direction. In order to maintain the movable displacement element 4 at the fixed displacement element 2 against these pressures, the movable displacement element 4 is supported on the supporting part 9.

Support of the movable displacement element 4 on the supporting part 9 also results from the gear arrangement 7. The three first bearing areas 10, 11, 24, which bear on the movable displacement element 4 serve this purpose. The three second bearing areas 12, 13, 25 of the gear arrangement 7 bear on the supporting part 9. In this way, the pressure that acts upon the movable displacement element 4 in the axial direction during operation of the scroll compressor 1, can be supported on the supporting part 9 via the base plate 5 of the movable displacement element 4, the first bearing areas 10, 11, 24, the supporting element 14 and further via the second bearing areas 12, 13, 25.

In the embodiment shown in FIG. 1, the supporting part 9 is plate-shaped and arranged on the housing 3 of the scroll compressor 1. The supporting part 9 can also be an integral part of the housing 3. Additionally, the supporting part 9 can also be arranged on the fixed displacement element 2 or be an integral part of it.

By the transmission of the axial pressure from the movable displacement element 4 to the gear arrangement 7 and from the gear arrangement 7 to the supporting part 9 via three of the bearing areas 10, 11, 12, 13, 24, 25 a very stable and tilt-proof supporting of the movable displacement element can be achieved. This is substantially caused by the statically determined bearing conditions, which are achieved in the axial direction.

Additionally, one of the first bearing areas 10, 11, 24 on the supporting element 14 is arranged opposite to one of the second bearing areas 12, 13, 25. In the direction of the acting pressure that has to be supported, the bearing areas 12, 13, 25 are thus placed directly behind the bearing areas 11, 10, 24. In this way, a direct pressure transmission from the movable displacement element 4 to the supporting part 9 is again possible. Thus, due to the acting axial pressure, also the supporting element 14 is merely exposed to compression load. Additional tensile forces or displacement torques to be adopted in the supporting element 14 can thus be avoided. It is therefore possible to make the supporting element 14 with only a small axial thickness. This again will reduce the total length of the scroll compressor 1.

To ensure a stable, approximately linear reciprocating movement of the gear arrangement 7 in relation to the movable displacement element 4 and the supporting part 9 along the movement directions 27, 28, two of the bearing pins 15, 16, 17, 26 are arranged on the upper side 29 and two on the bottom side 30 of the supporting element 14.

In addition to the determination of the reciprocating movement along the movement directions 27, 28 of the gear arrangement 7, the three bearing pins 15, 16, 26, via their bearing areas 10, 12, 24, also perform an axial bearing function. The fourth bearing pin 17, however, merely serves the purpose of guiding the gear arrangement 7 along the movement direction 28. Here, all bearing areas 10, 11, 12, 13, 24, 25 are made as slide bearings with the sliding surface 21.

Additional to the shown arrangement of the bearing areas 10, 11, 12, 13, 24, 25 on the supporting element 14 and the bearing pins 15, 16, 17, 26, also other configurations are possible. For example, all of the bearing areas 10, 11, 12, 13, 24, 25 can be made separately from the bearing pins 15, 16, 17, 26.

During operation, each sliding surface 21 of the bearing areas 10, 11, 12, 13, 24, 25 cooperate via a corresponding contact area with the movable displacement element 4 or the supporting part 9, respectively. A corresponding contact area of this kind can, for example, be the groove bottom of the pin paths 18, 19, 20, or merely a plane surface of the movable displacement element 4 or the supporting part 9, respectively. Of course, on the other hand, it is also possible to make a sliding surface 21 on the movable displacement element 4 or the supporting part 9, which cooperates with a corresponding contact area on the gear arrangement 7.

The shown bearing areas 10, 11, 12, 13, 24, 25 have sliding surfaces 21 with a hydrodynamic profile, for example, in FIGS. 2 to 5, in the shape of a curved surface. The curvature is oriented in the movement direction 27, 28 of the individual bearing areas 10, 11, 12, 13, 24, 25 occurring during operation. Due to this curvature, the sliding surfaces 21 merely cooperate with the movable displacement element 4 or the supporting part 9, respectively, via a line contact. With the curved design of the sliding surfaces 21 it is achieved that in connection with the movement of the bearing areas 10, 11, 12, 13, 24, 25 a good supply of lubricant to the line contact will result in the creation of a hydrodynamic lubricant layer. The lubricant is well distributed over the whole contact area. In the cross-section, the sliding surfaces 21 have the shape of an arc of a circle or another known curve shape.

Further, it is also possible to provide sliding surfaces 21 with a trapezoidal cross-section, as shown in FIG. 1. This gives an extensive contact between the bearing areas 10, 11, 12, 13, 24, 25 and the movable displacement element 4 or the supporting part 9, respectively, enabling, between these, in the respective turn points of the linear reciprocating movement, an improved lubrication, as with the low relative speed near the turn points, the surface contact will ensure the maintaining of the lubricant layer.

With such embodiments, it is possible, during operation of the scroll compressor 1 to provide a hydrodynamic lubricant layer, via which a pure fluid friction can be achieved, that causes a low-wear axial bearing.

Figure 6:
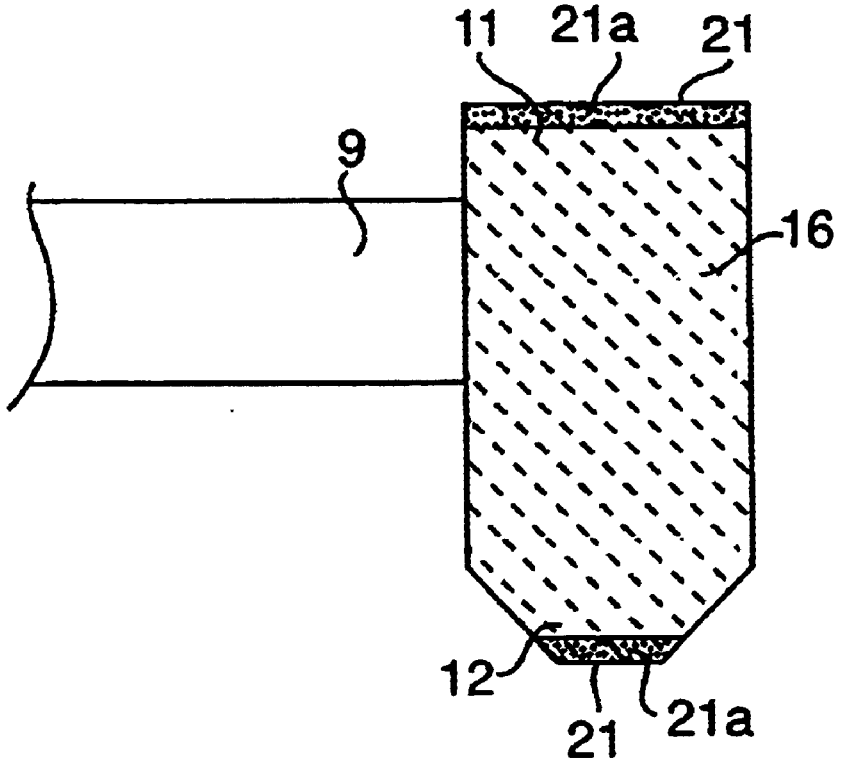
FIG. 6 is a partial view showing bearing areas possessing enhanced lubrication properties

As shown in FIG. 6, a further improvement of the frictional conditions in the scroll compressor 1 is achieved in that the sliding surfaces 21 have lubrication enhancing surfaces 21*a*. The lubrication enhancing surfaces 21*a* in the form of known microstructures, can be arranged in the whole bearing area 10,11,12,13,25, and 25. However, it is also possible that the sliding surfaces 21 are only partly provided with such surfaces, for example, in the actual contact zones.

Both the first bearing areas 10, 11, 24 and the second bearing areas 12, 13, 25 are arranged at relatively regular distances on the supporting element 14. For example, the three first bearing areas 10, 11, 24 or the three second bearing areas 12, 13, 25 can be arranged at the same distances of 120° around a central point or a centre of gravity of the supporting element 14. Thus, the stability when supporting the movable displacement element 4 is further increased. Additionally, this results in a good balancing of the gear arrangement 7 during operation.

In the embodiment shown, the supporting element 14 has an annular shape. Also this can contribute to a good balancing of the gear arrangement 7 and a steady and low-wear operation of the scroll compressor 1. Alternatively, it is also possible to connect the bearing pins 15, 16, 17, 26 and the bearing areas 10, 11, 12, 13, 24, 25 with each other via several straight supporting elements 14, for example, bars. This could improve the stability of the gear arrangement 7. Further, the material consumption and thus also the weight of the gear arrangement 7 is reduced. Further to annular or bar-shaped supporting elements 14, also all other known, suited shapes for the supporting element 14 can be used.

In order to achieve a good balancing of the gear arrangement 7, the bearing pins 15, 16, 17, 26 have substantially the same size. Depending on the load on the respective bearing pins 15, 16, 17, 26 during operation, however, it is possible to make them in different sizes. It is, for example, possible that the bearing pin 17, which merely serves the purpose of guiding the gear arrangement 7 along the movement direction 28, is made to be smaller than the other bearing pins 15, 16, 26, which at the same time also function as axial bearings.

In order to achieve that the gear arrangement 7 is less loaded by torques, which are generated by frictional tensions during the reciprocating movement, the bearing pins 15, 16, 17, 26 should have the smallest axial lengths possible. Additionally, such loads can be reduced in that each bearing area 10, 11, 12, 13, 24, 25 has a sliding surface 21 consisting of several parts, and that one of these parts is arranged at one end of the bearing area 10, 11, 12, 13, 24, 25 concerned and one part is arranged at the other end.

Independently of the embodiments shown, a gear arrangement 7 is also conceivable, which has a number of slide bearings, different from the number according to the invention.

What is claimed is:

1. A scroll compressor comprising:

at least one fixed displacement element;

at least one movable displacement element positioned adjacent to the fixed displacement and orbitally moveable relative thereto; and a gear arrangement in the form of an oldham coupling having bearing pins that converts orbiting movement into two perpendicular linear movements, positioned adjacent the movable displacement element for ensuring non-rotational motion of the movable displacement element the gear arrangement serving as an axial bearing defined by only three first bearing areas each cooperable with the movable displacement element.

2. A scroll compressor according to claim 1, wherein the axial bearing comprises exactly three second bearing areas generally opposite the first bearing areas, and the scroll compressor further comprises a supporting part positioned adjacent to and in cooperation with the three second bearing areas.

3. A scroll compressor according to claim 2, wherein the gear arrangement includes a supporting element, from which the first and second bearing areas extend with at least one of the first bearing areas being located generally opposite to one of the second bearing areas.

4. A scroll compressor according claim 1, wherein each bearing area defines a sliding surface.

5. A scroll compressor according to claim 4, wherein the sliding surface has a hydrodynamic profile.

6. A scroll compressor according to claim 5, wherein the sliding surfaces are curved in a movement direction, in which the sliding surfaces move in relation to the movable displacement element or the supporting part.

7. A scroll compressor according to claim 1, wherein at least a portion of the bearing areas have a surface with enhanced lubrication properties.

8. A scroll compressor according to claim 1, wherein at least one of the bearing areas is formed on a free end of a bearing pin, which cooperates with at least one of the movable displacement element and the supporting part approximately perpendicularly to an axial direction.

9. A scroll compressor according to claim 8, wherein at least one of the bearing pins cooperates with the movable displacement element and at least one other bearing pin cooperates with the supporting part approximately perpendicularly to the axial direction.

10. A scroll compressor according to claim 8, wherein two bearing pins project from a first side of the supporting element and two bearing pins project from a second side of the supporting element generally opposite the first side.

11. A scroll compressor according to claim 10, wherein three of the bearing pins each comprise a bearing area, with each of these three pins being ranged on the supporting element in the axial direction opposite to one of the other bearing areas.

12. A scroll compressor according to claim 8, wherein the bearing pins are approximately the same size.

13. A scroll compressor according to claim 8, wherein the bearing pins are different sizes.

14. A scroll compressor according to claim 3, wherein the supporting element defines an annular shape.

15. A scroll compressor according to claim 14, wherein one of the three first bearing areas and the three second bearing areas are arranged on the annular supporting element at mutual distances of approximately 120°.

* * * * *

UNITED STATES PATENT AND TRADEMARK OFFICE

CERTIFICATE OF CORRECTION

PATENT NO. : 6,666,669 B2
DATED : December 23, 2003
INVENTOR(S) : Jürgen Süss

It is certified that error appears in the above-identified patent and that said Letters Patent is hereby corrected as shown below:

Column 9,
Line 10, please replace “ranged” with -- arranged --.

Signed and Sealed this

Thirteenth Day of April, 2004

JON W. DUDAS
*Acting Director of the United States Patent and Trademark Office*